US011766147B2

(12) United States Patent
Benevento

(10) Patent No.: US 11,766,147 B2
(45) Date of Patent: Sep. 26, 2023

(54) APPARATUS FOR SECURING MAIL DELIVERIES

(71) Applicant: David Benevento, Folsom, CA (US)

(72) Inventor: David Benevento, Folsom, CA (US)

( * ) Notice: Subject to any disclaimer, the term of this patent is extended or adjusted under 35 U.S.C. 154(b) by 130 days.

(21) Appl. No.: 17/323,883

(22) Filed: May 18, 2021

(65) Prior Publication Data

US 2021/0267401 A1 Sep. 2, 2021

(51) Int. Cl.

| | |
|---|---|
| ***A47G 29/20*** | (2006.01) |
| ***G07C 9/00*** | (2020.01) |
| ***A47G 29/14*** | (2006.01) |
| ***E05B 65/52*** | (2006.01) |

(52) U.S. Cl.

CPC ..... *A47G 29/20* (2013.01); *A47G 29/141* (2013.01); *E05B 65/52* (2013.01); *G07C 9/00182* (2013.01); *A47G 2029/144* (2013.01)

(58) Field of Classification Search

CPC .... A47G 29/20; A47G 29/124; A47G 29/141; A47G 2029/144; E05B 65/52; G07C 9/00182; A45C 13/06; B65D 33/14

USPC ..... 232/19, 45, 38; 383/12, 22, 23

See application file for complete search history.

(56) References Cited

U.S. PATENT DOCUMENTS 188,403 A * 3/1877 Parker ..... A01M 31/00 383/92
459,631 A * 9/1891 Hanauer ..... A45C 7/0077 383/34.1
459,875 A * 9/1891 Locke ..... B65D 33/007 383/33
461,381 A * 10/1891 Richter ..... A47G 29/1207 383/34
605,343 A * 6/1898 Moody ..... A45C 3/00 383/22
632,273 A * 9/1899 Ross ..... A01M 31/00 383/34.1
991,252 A * 5/1911 Trask ..... A45C 3/06 150/123
1,027,524 A * 5/1912 Cook ..... A47G 29/1207 383/22
1,148,404 A * 7/1915 Prokesch ..... A45C 7/0063 383/30
1,164,833 A * 12/1915 Macaulay ..... A45C 3/06 294/149
2,468,897 A * 5/1949 Rothe ..... B65D 29/00 383/103
3,260,488 A * 7/1966 Kliewer ..... B65B 67/1244 383/68
4,372,363 A * 2/1983 Schmeling ..... B65D 33/06 383/34
5,492,272 A * 2/1996 Fewer ..... A47G 29/12 232/19

(Continued)

*Primary Examiner* — William L Miller
(74) *Attorney, Agent, or Firm* — Andrew S. Rapacke

(57) ABSTRACT

An apparatus for securing mail deliveries is disclosed, including a container dimensioned to receive a mail item. The container includes an opening dimensioned to receive the mail item which is stored within the interior of the perimeter. A frame is provided around the perimeter of the opening having one or more joints to permit the frame to open and close the opening of the container. The frame includes one or more supports having a U-shaped portion to hang from a door. A locking mechanism is in communication with the frame to securely lock the frame in a closed configuration.

13 Claims, 2 Drawing Sheets

(56) References Cited

U.S. PATENT DOCUMENTS

| | | | | |
|---|---|---|---|---|
| 5,624,071 | A * | 4/1997 | Sosan | E05B 67/003 232/29 |
| 10,093,454 | B1 * | 10/2018 | Kalyan | A47G 29/12 |
| 10,321,780 | B1 * | 6/2019 | James | A47G 29/141 |
| 10,512,352 | B1 * | 12/2019 | Torres | A47G 29/22 |
| 10,682,002 | B2 * | 6/2020 | Miller | A47G 29/20 |
| 11,406,212 | B2 * | 8/2022 | Odeh | A47G 29/141 |
| 11,412,876 | B1 * | 8/2022 | Kadlub | A47G 29/20 |
| 2007/0053616 | A1 * | 3/2007 | Plouff | A45C 13/1084 383/33 |
| 2017/0127868 | A1 * | 5/2017 | Adewuyi | A47G 29/22 |
| 2018/0162612 | A1 * | 6/2018 | Bojic | B65D 33/2516 |
| 2019/0246828 | A1 * | 8/2019 | Miller | A47G 29/124 |
| 2020/0093309 | A1 * | 3/2020 | Raphael | A47B 67/02 |
| 2020/0275795 | A1 * | 9/2020 | Campodonico | A47G 29/12095 |
| 2020/0383508 | A1 * | 12/2020 | Arif | A47G 29/20 |
| 2022/0007871 | A1 * | 1/2022 | Schwarz | A47G 29/141 |

* cited by examiner

APPARATUS FOR SECURING MAIL DELIVERIES

TECHNICAL FIELD

The embodiments relate to security devices and theft deterrents and, more specifically, relate to devices which secure packages upon delivery to deter theft.

BACKGROUND

Mail is used for the transportation of postcards, letters, and parcels. Services can be public or private, although each perform the similar function of collecting the item to be mailed, shipping the item near its destination, and delivering the item to a final location.

Upon delivery at the final location, some items may require the recipient to be present at the time of delivery. Further, some items may require a signature from a designated party. Many items, however, do not require the presence of the recipient. In these cases, the package may be left unattended for a period of time before it is collected by the recipient. This provides the opportunity for thieves to steal the package with little to no threat of detection.

With the increasing prevalence of online shopping, these types of deliveries for valuable goods have become more common. Consequently instances of package theft have risen. While some shippers attempt to conceal the value of the goods being delivered by using unmarked packaging, this does not conceal the package itself from view or protect it from theft once delivered.

Currently, some devices are available which protect the package such as lock boxes, drop boxes and similar systems. However, many of these are inaccessible or not feasible for home owners and are only implemented in apartments or other living complexes at which mail is delivered to a central location.

SUMMARY OF THE INVENTION

This summary is provided to introduce a variety of concepts in a simplified form that is further disclosed in the detailed description. This summary is not intended to identify key or essential inventive concepts of the claimed subject matter, nor is it intended for determining the scope of the claimed subject matter.

The present embodiments disclose an apparatus for securing mail deliveries, including a container dimensioned to receive a mail item. The container includes an opening dimensioned to receive the mail item which is stored within the interior of the perimeter. A frame is provided around the perimeter of the opening having one or more joints to permit the frame to open and close the opening of the container. The frame includes one or more supports having a U-shaped portion to hang from a door. A locking mechanism is in communication with the frame to securely lock the frame in a closed configuration.

The embodiments allow for the recipient to mount the apparatus to a door either permanently or during a time period when a mail item is expected such that the mail deliverer may dispose the mail item within the interior space of the container to deter theft of the mail item.

In one aspect, the frame is comprised of a plurality of joints to permit the frame to be folded.

In one aspect, the container is constructed of a flexible material. The flexible material may be expandable to permit the storage of larger mail items.

In one aspect, the mount permits the door to be closed and locked to retain the container to the door.

In one aspect, the apparatus further comprises a brace on the rear side of the container to support heavy mail items stored within the container.

In one aspect, the apparatus further comprises a locking mechanism in communication with the frame to enclose the mail item within the container.

BRIEF DESCRIPTION OF THE DRAWINGS

A more complete understanding of the present invention and the advantages and features thereof will be more readily understood by reference to the following detailed description when considered in conjunction with the accompanying drawings wherein.

DETAILED DESCRIPTION

Figure 1:
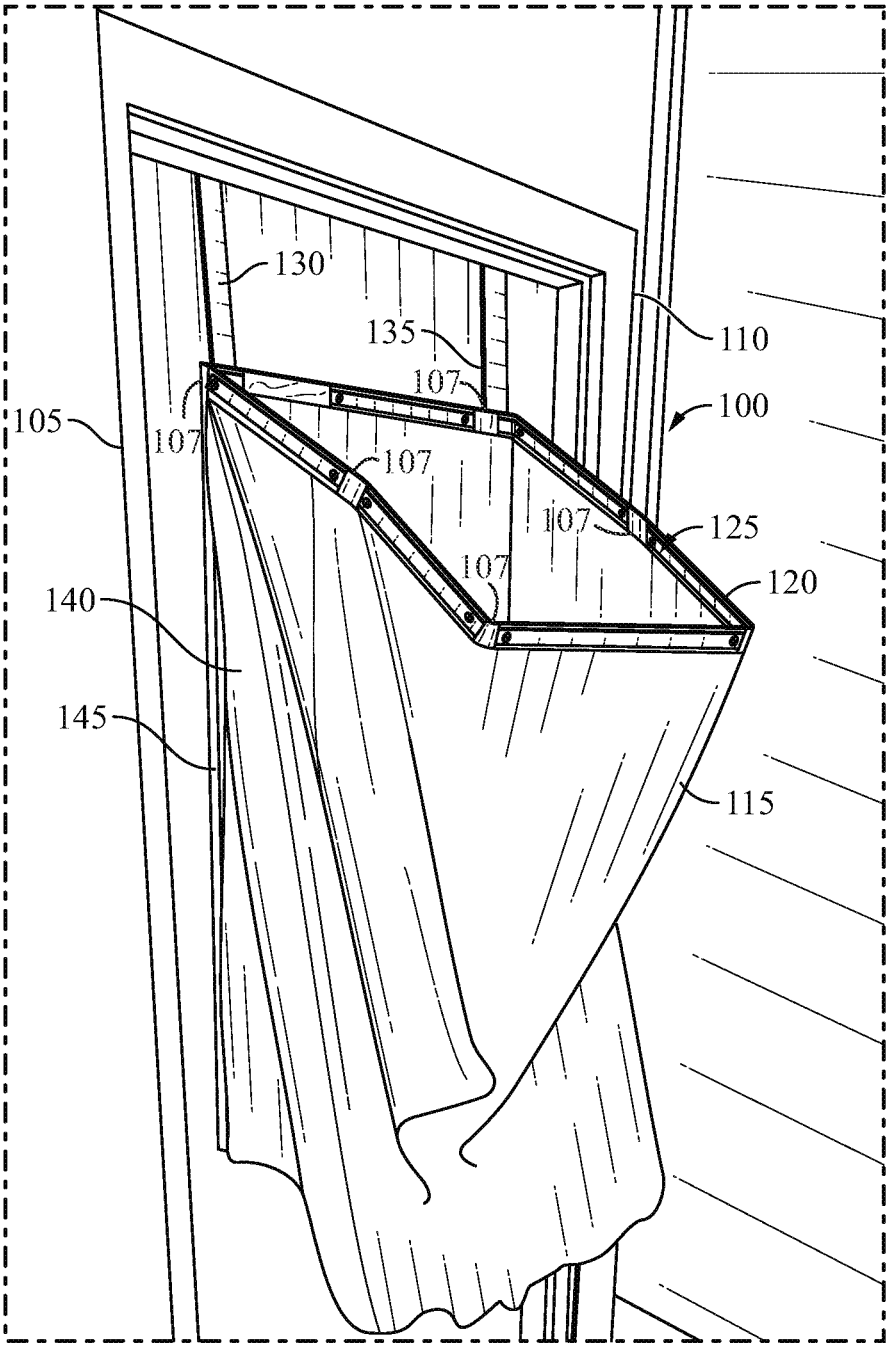
FIG. 1 illustrates a perspective view of the mail security apparatus, according to some embodiments.

The specific details of the single embodiment or variety of embodiments described herein are to a system and method of use. Any specific details of the embodiments are used for demonstrative purposes only and no unnecessary limitations or inferences are to be understood therefrom.

Before describing in detail exemplary embodiments, it is noted that the embodiments reside primarily in combinations of components related to the system and method. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second", "top" and bottom", and the like, may be used solely to distinguish one entity or element from another entity or element without necessarily requiring or implying any physical or logical relationship or order between such entities or elements.

As used herein, the term "mail item" refers to any letter, parcel, or other item which is deliverable by public and/or private mail delivery services.

In general, the embodiments described herein relate to an apparatus for securing delivered mail items at the delivery location to prevent theft of the mail item. The apparatus can be mounted to a structure or structure component to secure the apparatus thereto. The apparatus is at least partially enclosed to receive the mail item and retain the mail item out of view.

In reference to FIG. 1, the apparatus 100 is illustrated mounted to a door 105 of a structure 110. The apparatus 100 is removably engaged with the door 105 using a securing means such that the recipient of the mail item may mount or remove the apparatus 100 as desired. The apparatus includes a container 115 having an interior space wherein the mail item may be disposed by the mail deliverer. A frame 120 at least partially forms a perimeter around the opening 125 of the container 115. A plurality of supports 130,135 suspend the container 115 from the top of the door 105.

In some embodiments, the container is constructed of a flexible material to allow for the apparatus to be folded during storage. The flexible material may also be expandable to accommodate various sizes of mail items.

In some embodiments, the frame may be collapsible via a plurality of joints 107 to permit the frame to fold to facilitate storage of the apparatus. One skilled in the arts will readily understand that the joints 107 may be provided at various positions along the frame 120.

In some embodiments and in further reference to FIG. 1, the rear side 140 of the apparatus 100 includes a brace 145 to support the container 115. The brace 145 may be especially useful if a heavy mail item is to be retained within the container 115.

Figure 2:
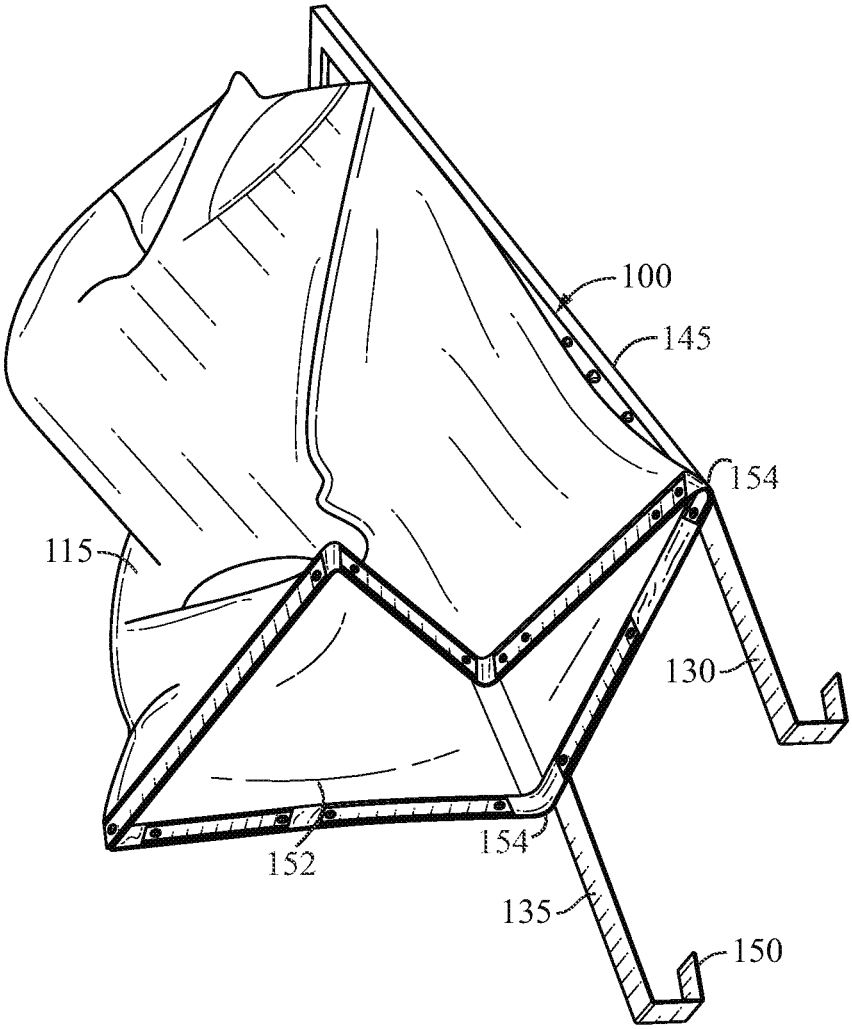
FIG. 2 illustrates a perspective view of the mail security apparatus, according to some embodiments.

FIG. 2 illustrates the apparatus 100 disengaged from the door. Each support 130,135 extends from the container 115 to a mount 150 dimensioned to releasably engage with the top of the door while retaining the ability of the door to close and lock such that the apparatus 100 is fixed to the door while the door is closed. The interior 152 is dimensioned to enclose a mail item within the container 115. Upper connections 154 connect the container 115 to the frame 120

Figure 3:
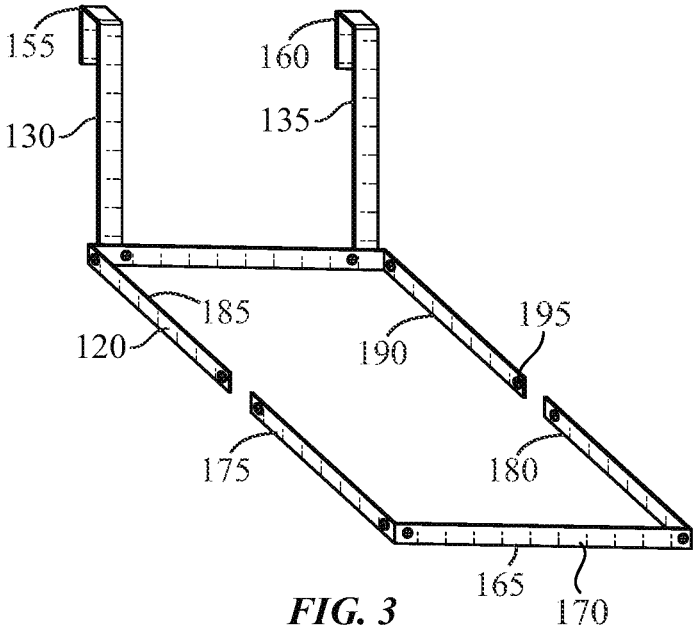
FIG. 3 illustrates a perspective view of the frame, according to some embodiments.

FIG. 3 illustrates a perspective view of the frame 120 separated from the container 115. The frame 120 includes a first support 130 and second support 135 each having a retainer portion 155, 160. Each retainer portion 155, 160 is generally u-shaped to extend over the top of the door and secure the frame 120 holding the container to the door. In such, when the door is closed, the frame 120 and apparatus are unable to be removed from the door. The frame 120 comprises a front portion 165 having a front member 170, and first left and first right side members 175,180 pivotally engaged with a second left side member 185 and a second right side member 190. In some embodiments, the frame 120 pivots between an open configuration and a closed configuration. Mail can be delivered by dropping the mail item into the opening of the container when the frame 120 is in an open configuration. When in a closed configuration, the interior space of the container is sufficiently sealed to prevent the contents (e.g., the mail) from being stolen or otherwise tampered with.

In some embodiments, the frame may be comprised of one or more locking mechanisms 195 (see FIG. 3) which retains the frame 120 in a closed and/or open configuration such that the opening of the container may be closed and locked following the delivery and disposal of the mail item within the interior space of the apparatus.

In some embodiments, the locking mechanism 195 can include a lock and key, a combination lock, or similar locking mechanism known in the arts.

In some embodiments, the locking mechanism 195 is an electronic locking mechanism in operable communication the users computing device (e.g., a smartphone, tablet, laptop computer, or similar network-connected computing device). The electronic locking mechanism may permit the user to lock and/or unlock the apparatus 100 from a remote location via a transceiver positioned in operable communication with the frame. In some embodiments, the frame 120 may include on or more actuators to open and close the opening 125 of the frame 120.

In some embodiments, the container 115 may be comprised of a durable material that is resistant to cutting, tearing, or degradation to prevent unauthorized access to the disposed mail contained therein once the locking mechanism 195 has been engaged. Further, the container 115 may be sufficiently waterproof to protect the mail contents from moisture while store within the container 115.

During use, the apparatus 100 is positioned on the door 105 by hanging the apparatus 100 on the top of the door 105 using the supports 130,135. The door 105 is then closed to prevent the removal of the apparatus 100. The apparatus 100 is hung on the door with the frame 120 in an open configuration (as shown in FIG. 1) to allow the items to be placed into the interior 152 through the opening 125. Once the items are placed within the container 115, the frame 120 is folded into a closed configuration and locked via the locking mechanism 195. The locking mechanism 195 may then be unlocked to permit the opening of the container 115 and the item(s) therein may be retrieved. When not in use, the apparatus 100 can be removed from the door 105, folded and stored.

In some embodiments, the frame 120 may be constructed of a suitably resilient material such as from various metals, metal alloys, plastics, etc. which prevent cutting, breaking, or otherwise tampering with. The container 115 and frame 120 may be connected via stitching, molding, bonding, adhesives, or other means of attachments.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. An apparatus for securing mail deliveries, the apparatus comprising:

a container dimensioned to receive a mail item, the container comprising an opening dimensioned to receive the mail item and store the mail item within an interior of the container;

a frame around the perimeter of the opening, the frame having one or more joints to permit the frame to open and close the opening of the container; and a locking mechanism in communication with the frame to securely lock the frame in a closed configuration, wherein the apparatus is releasably engaged with a door via at least one U-shaped support.

2. The apparatus of claim 1, wherein the frame is collapsible for storage.

3. The apparatus of claim 2, wherein the container is constructed of a flexible material.

4. The apparatus of claim 3, wherein the container is constructed of a waterproof material.

5. The apparatus of claim 1, further comprising a support configured to permits the door to be closed and locked to retain the container on the door.

6. The apparatus of claim 1, further comprising a brace on the rear side of the container.

7. The apparatus of claim 1, wherein the locking mechanism is a lock and key mechanism.

8. The apparatus of claim 1, wherein the locking mechanism is a combination locking mechanism.

9. An apparatus for securing mail deliveries, the apparatus comprising:

a container dimensioned to receive a mail item, the container comprising an opening dimensioned to receive the mail item and store the mail item within an interior of the container and a brace on a rear side of the container;

a frame around the perimeter of the opening, the frame having one or more joints to permit the frame to open and close the opening of the container, the frame comprising at least one support having a U-shaped portion to hang from a door, wherein the support is configured to permit the door to be closed and locked to retain the container on the door; and a locking mechanism in communication with the frame to securely lock the frame in a closed configuration, wherein the locking mechanism is a lock and key mechanism or a combination locking mechanism.

10. The apparatus of claim 9, wherein the locking mechanism prevents theft of the mail item disposed within the interior of the container.

11. The apparatus of claim 9, wherein the frame is collapsible for storage.

12. The apparatus of claim 11 wherein the container is constructed of a flexible material.

13. The apparatus of claim 12, wherein the container is constructed of a waterproof material.

* * * * *